US011257617B2

(12) United States Patent
Lee et al.

(10) Patent No.: US 11,257,617 B2
(45) Date of Patent: Feb. 22, 2022

(54) CONVERTER FOR VEHICLE

(71) Applicants: HYUNDAI MOTOR COMPANY, Seoul (KR); KIA MOTORS CORPORATION, Seoul (KR)

(72) Inventors: Woo Young Lee, Yongin-si (KR); Sang Chan Jeong, Seoul (KR); Ju Man Yoon, Seoul (KR); Jong Pil Kim, Yongin-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 651 days.

(21) Appl. No.: 16/212,498

(22) Filed: Dec. 6, 2018

(65) Prior Publication Data

US 2019/0304658 A1 Oct. 3, 2019

(30) Foreign Application Priority Data

Mar. 30, 2018 (KR) ..... 10-2018-0037043

(51) Int. Cl.
*H01F 27/02* (2006.01)
*H01F 27/22* (2006.01)
*H01F 27/28* (2006.01)

(52) U.S. Cl.
CPC ..... *H01F 27/22* (2013.01); *H01F 27/02* (2013.01); *H01F 27/2876* (2013.01)

(58) Field of Classification Search
CPC ..... H01F 27/22; H01F 27/02; H01F 27/2876; H01F 27/025; H01F 37/00; H01F 27/24; H01F 27/306; H01F 38/14
See application file for complete search history.

(56) References Cited

U.S. PATENT DOCUMENTS 4,631,509 A * 12/1986 Arii ..... H01F 30/16 336/197
4,754,250 A * 6/1988 Duin ..... H01F 27/027 336/205
7,129,808 B2 10/2006 Roebke et al.
2013/0027164 A1* 1/2013 Ooyama ..... H01F 37/00 336/90
2016/0078993 A1 3/2016 Cedell et al.

FOREIGN PATENT DOCUMENTS

JP 4772879 B2 9/2011
KR 10-1646375 B1 8/2016

* cited by examiner

*Primary Examiner* — Tuyen T Nguyen
(74) *Attorney, Agent, or Firm* — Morgan, Lewis & Bockius LLP

(57) ABSTRACT

A converter for a vehicle including an inductor which includes at least one coil, a core including a first region having an annular planar shape, around which the at least one coil is wound, and a second region having at least one first through-hole, a case accommodating the at least one coil and the core and including at least one cooling rod inserted into the at least one first through-hole, and a fixing bolt fastened to the at least one cooling rod exposed through the at least one first through-hole to fix the core to the case.

14 Claims, 5 Drawing Sheets

CONVERTER FOR VEHICLE

CROSS REFERENCE TO RELATED APPLICATION

This application claims priority under 35 U.S.C. § 119 to Korea Application No. 10-2018-0037043 filed in Korea on 30 Mar. 2018 which is hereby incorporated in its entirety by reference as if fully set forth herein.

TECHNICAL FIELD

The present disclosure relates to a converter for a vehicle.

BACKGROUND

Recently, with rising concerns about environmental pollution and depletion of resources, technology related to environmentally friendly vehicles has been actively developed. Particularly, in order to meet the requirements of stringent regulations for vehicle exhaust emissions and to improve fuel efficiency of vehicles, hybrid vehicles have been developed and are now commercially available.

Hybrid vehicles and other environmentally friendly vehicles, such as plug-in hybrid electric vehicles, fuel cell vehicles, etc., employ various kinds of converters related to a high-voltage battery. Recently, in order to increase the mileage and the power performance of vehicles, high-capacity batteries of environmentally friendly vehicles increase so that power of converters has increased.

With the increase in the power of the converter, an inductor included in the high-capacity converter becomes bigger. Therefore, a design for effectively withstanding vibration is being demanded, and study on a method of reducing the size thereof is being actively conducted.

SUMMARY

Exemplary embodiments of the present disclosure are directed to a converter for a vehicle that substantially obviates one or more problems due to limitations and disadvantages of the related art.

An object of embodiments is to provide a converter for a vehicle having a superior fixation performance capable of withstanding vibration such as shaking of a vehicle and exhibiting improved cooling performance.

In one embodiment, a high-capacity converter for a vehicle may include an inductor, and the inductor includes at least one coil, a core including a first region, around which the at least one coil is wound and which has an annular planar shape, and a second region having at least one first through-hole, a case accommodating the at least one coil and the core and including at least one cooling rod inserted into the at least one first through-hole, and a fixing bolt fastened to the at least one cooling rod exposed through the at least one first through-hole to fix the core to the case.

The cooling rod may include at least one second through-hole to which the fixing bolt is fastened. The at least one second through-hole may be located within the first through-hole in the second region of the core.

The inductor may further include a bushing disposed in the at least one second through-hole so as to be located between the fixing bolt and the cooling rod.

The at least one coil may include a first coil and a second coil wound around the first region of the core so as to face each other in a first direction.

The at least one first through-hole may include a 1-1$^{st}$ through hole and a 1-2$^{nd}$ through-hole formed in the second region so as to face each other in a second direction intersecting the first direction.

The first direction may correspond to a longitudinal direction of the case, and the second direction may correspond to a width direction of the case.

The at least one second through-hole may include a 2-1$^{st}$ through-hole and a 2-2$^{nd}$ through-hole respectively exposed through the 1-1$^{st}$ through-hole and the 1-2$^{nd}$ through-hole, and the fixing bolt may include a first fixing bolt and a second fixing bolt respectively fastened to the 2-1$^{st}$ through-hole and the 2-2$^{nd}$ through-hole.

The first fixing bolt and the second fixing bolt may be arranged symmetrical to each other when viewed in plan.

The case may include a thermally conductive material.

The inductor may further include a molding member filling a space between the core having the coil wound therearound and the inner surface of the case.

The molding member may include one of thermally conductive silicon and thermally conductive epoxy.

The cooling rod may have thermal conductivity higher than the thermal conductivity of each of the core, the coil and the molding member.

The 1-1$^{st}$ through-hole and the 1-2$^{nd}$ through-hole may be arranged symmetrical to each other on the basis of the center of a hollow portion formed in the center of the annular planar shape of the core when viewed in plan.

The cooling rod may have one of a cylindrical shape and a hexagonal prism shape.

The bushing may include a thermally conductive material.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
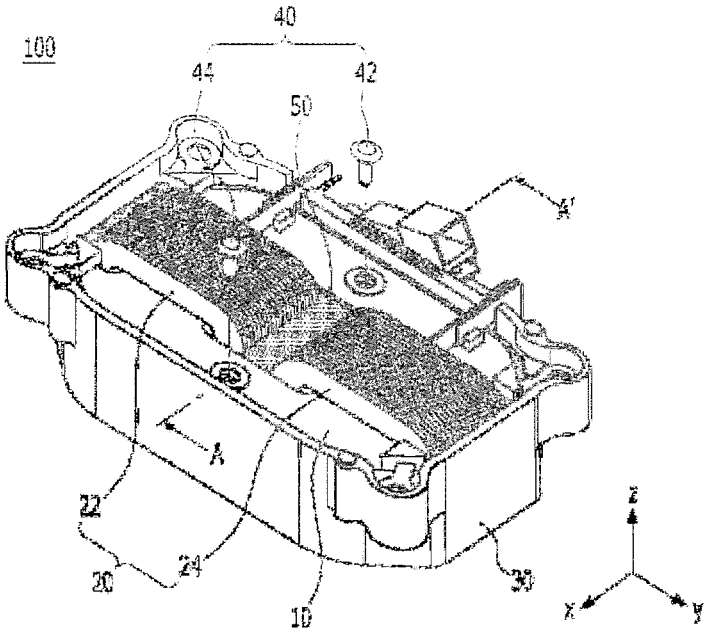
FIG. 1 is a perspective view showing a partially coupled state of an inductor included in a high-capacity converter for a vehicle according to an embodiment of the present disclosure.

The present disclosure will now be described more fully hereinafter with reference to the accompanying drawings, in which various embodiments are shown. The examples, however, be embodied in many different forms and should not be construed as being limited to the embodiments set forth herein. Rather, these embodiments are provided so that this disclosure will be more thorough and complete, and will more fully convey the scope of the disclosure to those skilled in the art.

In addition, as used herein, relational terms, such as "first", "second", "on"/"upper"/"above", "under"/"lower"/"below", and the like, are used solely to distinguish one entity or element from another entity or element without necessarily requiring or implying any physical or logical relationship or order between such entities or elements.

Hereinafter, an inductor 100 included in a high-capacity converter for a vehicle according to embodiments will be described using a Cartesian coordinate system (x, y, z). However, other different coordinate systems may be used. In the drawings, an x-axis, a y-axis, and a z-axis of the Cartesian coordinate system are perpendicular to each other. However, the disclosure is not limited thereto. That is, the x-axis, the y-axis, and the z-axis may intersect each other.

FIG. 1 is a perspective view showing a partially coupled state of the inductor 100 included in a high-capacity converter for a vehicle according to an embodiment.

In general, a high-capacity converter for a vehicle may be constituted by an inductor and a power semiconductor. One example of the power semiconductor includes an insulated gate bipolar mode transistor (IGBT). However, the embodiment is not limited to specific kinds or types of elements other than the inductor 100, which constitute the high-capacity converter for a vehicle.

Referring to FIG. 1, the inductor 100 may include a core 10, at least one coil 20, a case 30, and fixing bolts 40.

Figure 2A:
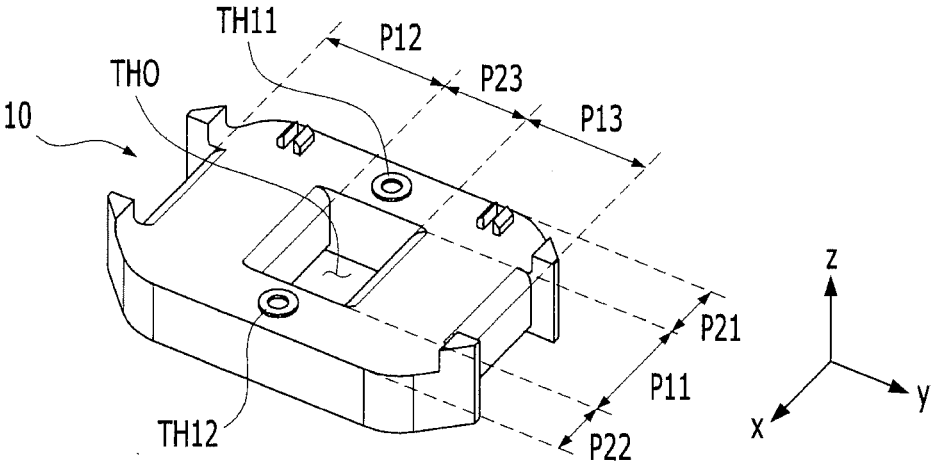
FIGS. 2A to 2C are perspective views respectively showing a core, at least one coil, and a case depicted in FIG. 1.
Figure 2B:
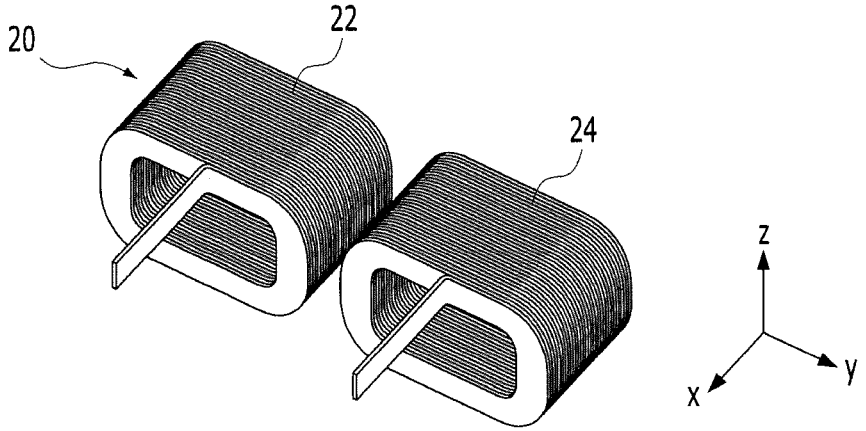
Figure 2C:
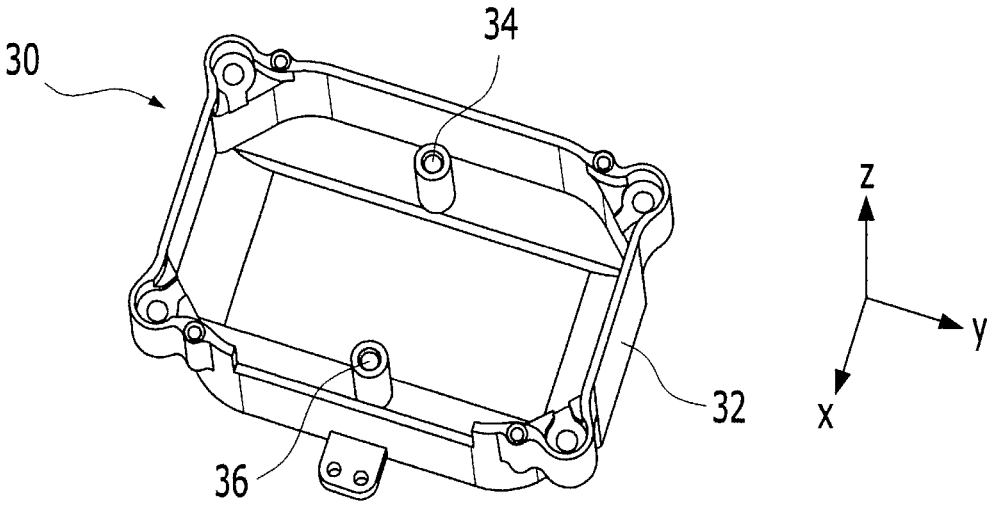

FIGS. 2A to 2C are perspective views respectively showing the core 10, the at least one coil 20, and the case 30 depicted in FIG. 1.

Referring to FIG. 2A, the core 10 has an annular planar shape. That is, the core 10 may be formed in an annular planar shape having a hollow portion TH0 formed in the center thereof. As illustrated, the hollow portion TH0 may have a rectangular planar shape. Alternatively, unlike the drawings, the hollow portion TH0 may have a circular planar shape. The embodiment is not limited to the specific planar shape of the hollow portion TH0. The size of the hollow portion TH0 when viewed in plan may be determined in proportion to the number of windings of the coil 20 wound around the core 10.

The core 10 may include a first region and a second region.

The first region is a region around which the at least one coil 20 is wound. Referring to FIG. 2A, the first region may include a portion at which a 1-1$^{st}$ portion P11 and a 1-2$^{nd}$ portion P12 intersect each other and a portion at which the 1-1$^{st}$ portion P11 and a 1-3$^{rd}$ portion P13 intersect each other.

The at least one coil 20 may include a first coil 22 and a second coil 24, which face each other in a first direction (e.g. in the y-axis direction) and are wound around the first region of the core 10. The first direction may correspond to a longitudinal direction of the case 30.

The number of windings of each of the first coil 22 and the second coil 24 wound around the core 10 may be determined depending on the inductance to be realized by the inductor 100.

The second region of the core 10 is a region in which first through-holes TH1 are formed when viewed in plan. For example, the first through-holes TH1 may include a 1-1$^{st}$ through-hole TH11 and a 1-2$^{nd}$ through-hole TH12.

The 1-1$^{st}$ through-hole TH11 and the 1-2$^{nd}$ through-hole TH12 may be arranged symmetrical to each other on the basis of the center of the hollow portion TH0 when viewed in plan.

According to one embodiment, as shown in FIG. 2A, the 1-1$^{st}$ through-hole TH11 and the 1-2$^{nd}$ through-hole TH12 may be formed in the second region so as to face each other in a second direction (e.g. in the x-axis direction), which intersects the first direction. The second region, in which the 1-1$^{st}$ through-hole TH11 and the 1-2$^{nd}$ through-hole TH12 are disposed, may be a region at which each of a 2-1$^{st}$ portion P21 and a 2-2$^{nd}$ portion P22 intersects a 2-3$^{rd}$ portion P23. That is, the 1-1$^{st}$ through-hole TH11 may be formed in a portion of the second region at which the 2-1$^{st}$ portion P21 and the 2-3$^{rd}$ portion P23 intersect each other, and the 1-2$^{nd}$ through-hole TH12 may be formed in a portion of the second region at which the 2-2$^{nd}$ portion P22 and the 2-3$^{rd}$ portion P23 intersect each other. For example, the second direction may be a width direction of the case 30.

According to another embodiment, unlike the configuration illustrated in FIG. 2A, the second region, in which the 1-1$^{st}$ through-hole TH11 and the 1-2$^{nd}$ through-hole TH12 are disposed, may include a portion at which the 1-2$^{nd}$ portion P12 and the 2-1$^{st}$ portion P21 intersect each other and a portion at which the 1-3$^{rd}$ portion P13 and the 2-2$^{nd}$ portion P22 intersect each other. That is, the 1-1$^{st}$ through-hole TH11 may be formed in the portion at which the 1-2$^{nd}$ portion P12 and the 2-1$^{st}$ portion P21 intersect each other, and the 1-2$^{nd}$ through-hole TH12 may be formed in the portion at which the 1-3$^{rd}$ portion P13 and the 2-2$^{nd}$ portion P22 intersect each other.

However, the second region, in which the first through-holes TH1 (TH11 and TH12) are formed, is not limited to the above-described embodiment. That is, the first through-holes TH1 (TH11 and TH12) may be formed in various other positions in the core 10, as long as they are arranged symmetrical to each other when viewed in plan.

Although it is illustrated in FIGS. 1 and 2A that the number of first through-holes TH1 is two, the embodiment is not limited to any specific number of first through-holes TH1. That is, the number of first through-holes TH1 may be one, or may be three or more.

The case 30 serves to accommodate the coil 20 and the core 10. The case 30 may include cooling rods, which are inserted into the first through-holes TH1.

Referring to FIG. 2C, the case 30 may include a body 32 and cooling rods 34 and 36. The cooling rods 34 and 36 may protrude toward the core 10 from the body 32, and may be formed integrally with the body 32.

Although it is illustrated in FIG. 2C that the number of cooling rods 34 and 36 is two, the embodiment is not limited to the specific number of cooling rods 34 and 36. Because the cooling rods 34 and 36 are inserted into the first through-holes TH1, the number of cooling rods 34 and 36 may be equal to or less than the number of first through-holes TH1. Therefore, in order to allow the cooling rods 34 and 36 to be inserted into the first through-holes TH1, each of the first through-holes TH1 may have an inner diameter that is greater than the outer diameter of a respective one of the cooling rods 34 and 36.

The cooling rods 34 and 36 may have therein second through-holes TH2. The second through-holes TH2 may include a 2-1$^{st}$ through-hole TH21 and a 2-2$^{nd}$ through-hole TH22, which are exposed through the first through-holes TH1 (TH11 and TH12). The second through-holes TH2, namely, the 2-1$^{st}$ through-hole TH21 and the 2-2$^{nd}$ through-hole TH22, are illustrated in FIG. 3, which will be described later.

As illustrated in FIG. 2C, each of the cooling rods and 36 may have a cylindrical shape. However, the embodiment is not limited thereto. According to another embodiment, each of the cooling rods 34 and 36 may have a hexagonal prism shape.

Figure 3:
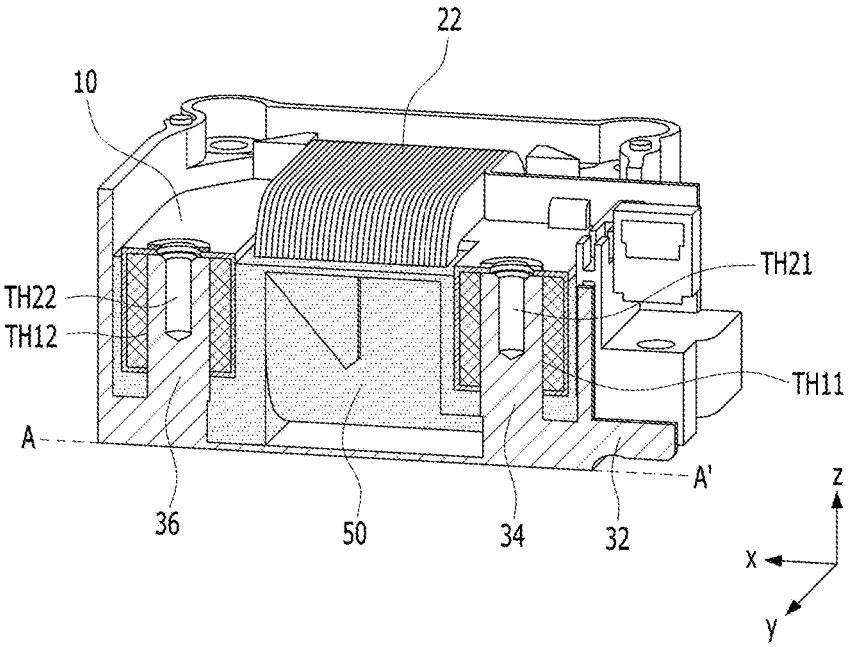
FIG. 3 is a perspective view showing the cross-section of the inductor taken along line A-A' in FIG. 1.

FIG. 3 is a perspective view showing the cross-section of the inductor 100 taken along line A-A' in FIG. 1.

The fixing bolts 40 serve to fix the core 10 to the case 30. To this end, the fixing bolts 40 may be fastened to the cooling rods 34 and 36 through the second through-holes TH2 (TH21 and TH22), which are respectively formed in the cooling rods 34 and 36. For example, the fixing bolts 40 may include first and second fixing bolts 42 and 44, which are respectively fastened to the cooling rods 34 and 36 through the 2-1$^{st}$ and 2-2$^{nd}$ through-holes TH21 and TH22. Each of the second through-holes TH2 (TH21 and TH22) may be located within a respective one of the first through-holes TH1 (TH11 and TH12) in the second region of the core 10.

The number of second through-holes TH2 may be equal to the number of first through-holes TH1 or the number of cooling rods 34 and 36. However, the embodiment is not limited thereto. Although it is illustrated in the drawings that the number of second through-holes TH2 is two, the embodiment is not limited to any specific number of second through-holes TH2. That is, the number of second through-holes TH2 may be one, or may be three or more.

The reason for the symmetrical arrangement of the 1-1$^{st}$ and 1-2$^{nd}$ through-holes TH11 and TH12 when viewed in plan is to arrange the first and second fixing bolts 42 and 44 symmetrically to each other on the basis of the center of the hollow portion TH0 when viewed in plan.

In order to dissipate heat generated from the core 10 and the coil 20 due to loss, the case 30 may include a thermally conductive material. For example, each of the body 32 of the case 30 and the cooling rods 34 and 36 may be formed of aluminum (Al).

Figure 4:
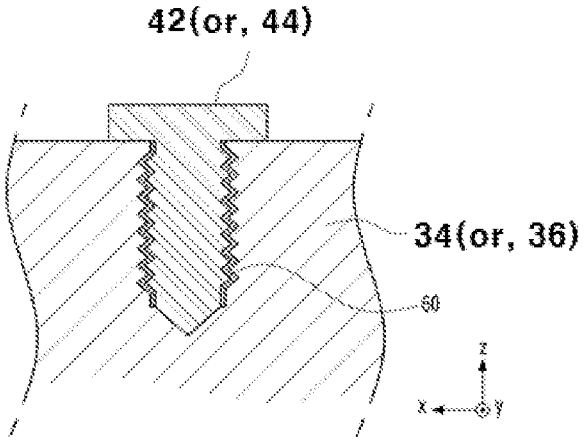
FIG. 4 is a partial cross-sectional view showing the state in which a cooling rod and a fixing bolt are engaged with each other.

FIG. 4 is a partial cross-sectional view showing the state in which the cooling rod 34 and the fixing bolt 42 are engaged with each other.

The inductor 100 according to the embodiment may further include a bushing 60. The bushing 60 may be disposed between the fixing bolt 42 and the cooling rod 34. For example, as shown in FIG. 4, the bushing 60 may be disposed between the fixing bolt 42 and the cooling rod 34. As shown in FIG. 4, one 42 of the fixing bolts 40 and one cooling rod are engaged with each other, with the bushing 60 interposed therebetween. In the same way as shown in FIG. 4, the other 44 of the fixing bolts 40 and the other cooling rod 36 may also be engaged with each other, with the bushing 60 interposed therebetween. That is, as shown in FIG. 4, the bushing 60 may also be disposed between the other fixing bolt 44 and the other cooling rod 36. In order to dissipate heat generated from the core 10 and the coil 20 to the outside via the cooling rods 34 and 36 and the fixing bolts 40, the bushing 60 may be formed of a thermally conductive material, e.g. metal. However, the embodiment is not limited thereto.

When the fixing bolts 40 (42 and 44) are fastened to the cooling rods 34 and 36, the above-described bushing 60 may prevent the cooling rods 34 and 36 from being damaged by the fixing bolts 40 (42 and 44). This is because the bushing 60 may disperse force that is applied to the cooling rods 34 and 36 when the fixing bolts 40 (42 and 44) are fastened to the same. Moreover, the core 10 may be more securely fixed to the case 30 thanks to the provision of the bushing 60. The bushing 60 may be omitted as needed.

Referring back to FIGS. 1 and 3, the inductor 100 according to the embodiment may further include a molding member 50. The molding member 50 fills the space between the core 10 having the coil 20 wound therearound and the inner surface of the case 30, and serves to rapidly transfer heat generated from the core 10 and the coil 20 to the case 30. To this end, the molding member 50 may include thermally conductive silicon or thermally conductive epoxy.

Hereinafter, a method of manufacturing the inductor 100 according to the above-described embodiment will be described.

Firstly, the coil 20 is wound around the first region of the core 10.

Subsequently, the core 10 having the coil 20 wound therearound is mounted to the case 30. At this time, the cooling rods 34 and 36 are inserted into and fitted in the first through-holes TH1 formed in the core 10.

Subsequently, the core 10 is fixed to the case 30 via the cooling rods 34 and 36 by coupling the fixing bolts (42 and 44) to the second through-holes TH2 (TH21 and TH22). When the fixing bolts 40 are fitted in and fastened to the second through-holes TH2, the bushing 60 may be used, as shown in FIG. 4.

Subsequently, a silicon or epoxy molding solution having high thermal conductivity is injected into the space between the core 10 having the coil 20 wound therearound and the inner surface of the case 30. Subsequently, the molding solution is cured to form the molding member 50, thereby completing manufacture of the inductor 100.

Alternatively, according to another embodiment, the fixing bolts 40 may be fitted in the second through-holes TH2 after the molding member 50 is formed.

Hereinafter, a description of a comparison between an inductor according to a comparative example and the inductor according to the embodiment will be made.

Figure 5:
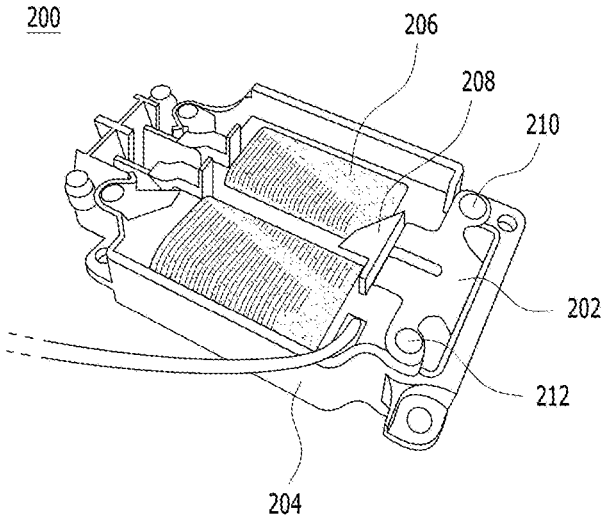
FIG. 5 is a perspective view showing the external appearance of an inductor of a high-capacity converter for a vehicle according to a comparative example.

FIG. 5 is a perspective view showing the external appearance of an inductor 200 of a high-capacity converter for a vehicle according to the comparative example.

The inductor 200 shown in FIG. 5 includes a fixing clip 202, a case 204, a coil 206, a core 208, and a bolt 210. The case 204, the coil 206 and the core 208 shown in FIG. 5 respectively perform the same functions as the case 30, the coil 20 and the core 10 shown in FIG. 1, and therefore a duplicate description of the functions of these components 204, 206 and 208 will be omitted.

Because the high-capacity converter including the inductor 200 is used for a vehicle, the inductor 200 needs to be designed to withstand vibration of a vehicle. To this end, the inductor 200 according to the comparative example employs the fixing clip 202 in order to fix the core 208 to the case 204.

One end of the fixing clip 202 presses the core 208. The bolt 210 fixes each of the two ends of the fixing clip 202 to the case 204. As such, in the case of the comparative example, in order to fix the core 208 to the case 204, a space in which the fixing clip 202 and the bolt 210 are disposed is additionally needed. Therefore, the overall size of the inductor 200 may inevitably increase. Moreover, because the fixing clip 202 is located to the outermost edge of the core 208 when viewed in plan, the performance of fixing the core 208 may be lowered.

In contrast, in the inductor 100 according to the embodiment, an additional space, in which the fixing clip 202 and the bolt 210 are disposed, is not needed. This is because the core 10 is fixed to the case 30 in a manner such that the fixing bolts 40 are disposed at the core 10 and are fastened to the cooling rods 34 and 36. Therefore, the inductor 100 according to the embodiment may be formed smaller than the inductor 200 according to the comparative example. In addition, the inductor 100 according to the embodiment does not need an additional fixing clip 202, leading to a reduction in manufacturing costs.

Further, the core 10 is more securely fixed to the case 30, and the fixation performance of withstanding vibration of a vehicle may be more significantly improved in a configuration according to the embodiment in which the fixing bolts 42 and 44 are arranged symmetrical to each other when viewed in plan than in a configuration in which the bolts 42 and 44 are arranged asymmetrically when viewed in plan or in which only one fixing bolt is disposed at one side of the core 10.

Further, heat generated from the core 10 and the coil 20 is rapidly transferred to the case 30 via the molding member 50 in case that the thermally conductive molding member 50 fills the empty space between the core 10 having the coil 20 wound therearound and the inner surface of the case 30, whereby the cooling performance is further improved.

In addition, heat generated from the core 10 and the coil 20 may be dissipated to the outside more rapidly and effectively when the fixing bolts 42 and 44 are arranged symmetrical to each other when viewed in plan than when the bolts 42 and 44 are arranged asymmetrically when viewed in plan or when only one fixing bolt is disposed at one side of the core 10.

Furthermore, heat generated from the core 10 and the coil 20 is dissipated through the case 30 via the cooling rods 34 and 36 since the cooling rods 34 and 36 are inserted into the first through-holes TH1 (TH11 and TH12) formed in the core 10 in the inductor 100 according to the embodiment, whereby the cooling efficiency may be further improved.

In the inductor 200 according to the comparative example, a route along which heat in the inductor 200 is dissipated to the outside is as follows.

Heat generated from the coil 206 and the core 208 of the inductor 200 is transferred to the case 204 of the inductor 200. Subsequently, the heat transferred to the case 204 is transferred to the thermal grease, which is located on the bottom surface of the inductor 200. Finally, the heat of the thermal grease may be dissipated to the outside through a flow passage formed in the housing.

As described above, since heat of the inductor 200 may be dissipated to the outside through the lower portion of the inductor 200, the temperature of the upper portion of the inductor 200 is higher than the temperature of the lower portion of the inductor 200 at all times. Further, heat present at the portion that is close to the case 204 in a region of the upper portion of the inductor 200 may travel to the lower portion of the inductor 200 through the case 204. As such, heat generated in the inductor 200 according to the comparative example is distributed such that the temperature of the center of the upper portion of the inductor 200 is higher than the temperature of the remaining portion of the inductor 200. Thus, it may be difficult for the inductor 200 according to the comparative example to perform its function due to a relatively high temperature.

In the inductor 100 according to the embodiment, a route along which heat is dissipated to the outside is as follows.

Figure 6:
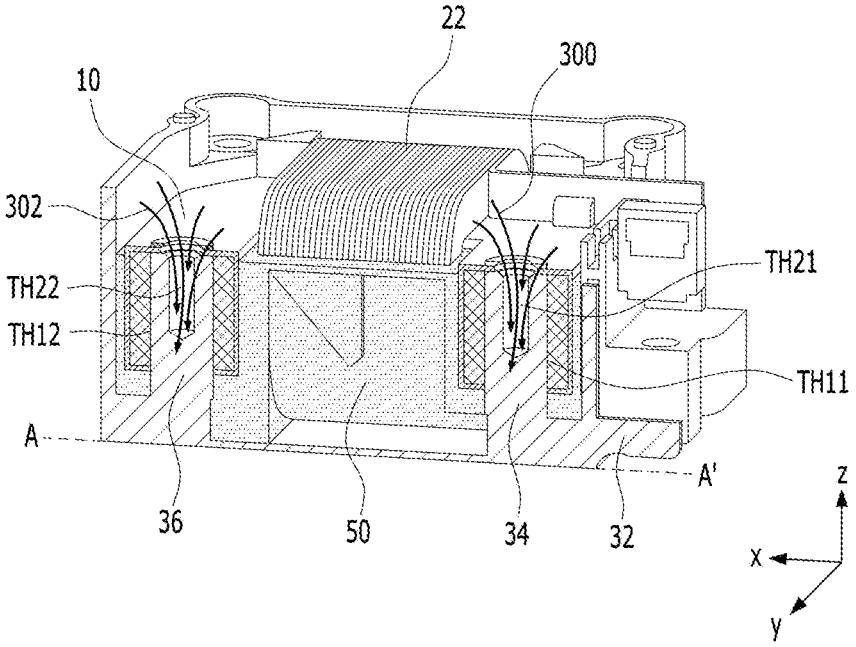
FIG. 6 is a view for explaining a route along which heat generated in the inductor according to the embodiment illustrated in FIG. 3 is dissipated to the outside.

FIG. 6 is a view for explaining the route along which heat generated in the inductor 100 according to the embodiment illustrated in FIG. 3 is dissipated to the outside.

Figure 7:
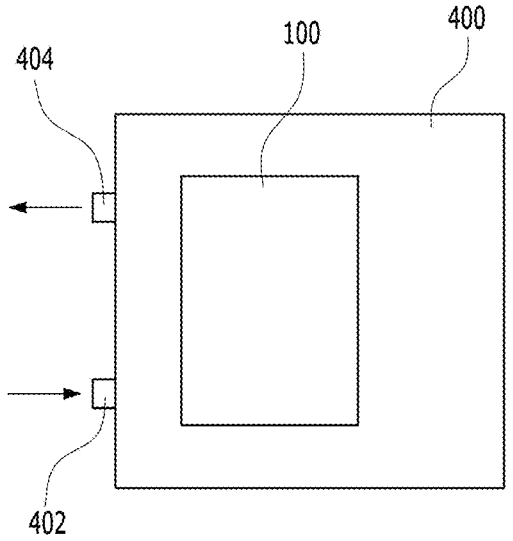
FIG. 7 is a conceptual view schematically showing a housing in which the inductor according to the embodiment is disposed.

FIG. 7 is a conceptual view schematically showing a housing 400 in which the inductor 100 according to the embodiment is disposed.

Heat generated from the core 10 and the coil 20, as indicated by the arrows 300 and 302 in FIG. 6, is transferred to the cooling rods 34 and 36 inserted into the first through-holes TH1 (TH11 and TH12) formed in the core 10. Subsequently, the heat transferred to the cooling rods 34 and 36 is transferred to the body 32 of the case 30. The heat generated from the core 10 and the coil 20 may also be transferred to the body 32 of the case 30 through the molding member 50. The heat transferred to the body 32 of the case 30 may be dissipated to the outside through the housing 400.

Coolant is introduced into the housing 400 through an inlet port 402 of the housing 400 in the direction indicated by the arrow. Subsequently, while flowing through a cooling passage, the coolant absorbs heat from the case 30 of the inductor 100 mounted to the housing 400. The coolant that has absorbed heat may be discharged to the outside of the housing 400 through an outlet port 404.

Each of the cooling rods 34 and 36 and the housing 400 may have thermal conductivity (referred to as "first thermal conductivity") that may be greater than the thermal conductivity (referred to as "second thermal conductivity") of each of the core 10, the coil 20 and the molding member 50. For example, the first thermal conductivity may be about 1000 W/mk, and the second thermal conductivity may range from about 1 W/mk to about 10 W/mk. Accordingly, the insertion of the cooling rods 34 and 36 into the first through-holes TH1 (TH11 and TH12) formed in the core 10 may enhance the cooling performance of the inductor 100 according to the embodiment.

As is apparent from the above description, a high-capacity converter for a vehicle according to the embodiment has a superior fixation performance capable of withstanding external vibration, exhibits improved cooling performance, and can be manufactured to be compact at low cost.

While the present disclosure has been particularly shown and described with reference to exemplary embodiments thereof, these embodiments are only proposed for illustrative purposes and do not restrict the present disclosure, and it will be apparent to those skilled in the art that various changes in form and detail may be made without departing from the essential characteristics of the embodiments set forth herein. For example, respective configurations set forth in the embodiments may be modified and applied. Further, differences in such modifications and applications should be construed as falling within the scope of the present disclosure as defined by the appended claims.

What is claimed is:

1. A converter for a vehicle comprising an inductor, the inductor comprising:

at least one coil;

a core comprising:

a first region around which the at least one coil is wound, the first region having an annular planar shape; and a second region having at least one first through-hole;

a case accommodating the at least one coil and the core, the case comprising at least one cooling rod inserted into the at least one first through-hole; and a fixing bolt fastened to the at least one cooling rod exposed through the at least one first through-hole to fix the core to the case, wherein the at least one coil comprises a first coil and a second coil, both of which are wound around the first region of the core to face each other in a first direction, and wherein the at least one first through-hole comprises a 1-1$^{st}$ through hole and a 1-2$^{nd}$ through-hole in the second region to face each other in a second direction intersecting the first direction.

2. The converter according to claim 1, wherein the at least one cooling rod comprises at least one second through-hole to which the fixing bolt is fastened.

3. The converter according to claim 2, wherein the at least one second through-hole is located within the at least one first through-hole in the second region of the core.

4. The converter according to claim 2, wherein the inductor further comprises a bushing disposed in the at least one second through-hole between the fixing bolt and the at least one cooling rod.

5. The converter according to claim 1, wherein the first direction corresponds to a longitudinal direction of the case, and wherein the second direction corresponds to a width direction of the case.

6. The converter according to claim 1, wherein the at least one second through-hole comprises a 2-1$^{st}$ through-hole and a 2-2$^{nd}$ through-hole respectively exposed through the 1-1$^{st}$ through-hole and the 1-2$^{nd}$ through-hole, and wherein the fixing bolt comprises a first fixing bolt and a second fixing bolt respectively fastened to the 2-1$^{st}$ through-hole and the 2-2$^{nd}$ through-hole.

7. The converter according to claim 6, wherein the first fixing bolt and the second fixing bolt are arranged symmetrical to each other when viewed in plan.

8. The converter according to claim 1, wherein the case comprises a thermally conductive material.

9. The converter according to claim 1, wherein the inductor further comprises a molding member filling a space between the core having the at least one coil wound therearound and an inner surface of the case.

10. The converter according to claim 9, wherein the molding member comprises one of thermally conductive silicon and thermally conductive epoxy.

11. The converter according to claim 9, wherein the at least one cooling rod has thermal conductivity higher than thermal conductivity of each of the core, the at least one coil, and the molding member.

12. The converter according to claim 1, wherein the 1-1$^{st}$ through-hole and the 1-2$^{nd}$ through-hole are arranged symmetrical to each other on a basis of a center of a hollow portion in a center of the annular planar shape of the core when viewed in plan.

13. The converter according to claim 1, wherein the at least one cooling rod has a cylindrical shape or a hexagonal prism shape.

14. The converter according to claim 4, wherein the bushing comprises a thermally conductive material.

* * * * *